United States Patent [19]

Ingram et al.

[11] Patent Number: 5,012,630

[45] Date of Patent: May 7, 1991

[54] CLOSURE APPLICATION SYSTEM

[75] Inventors: Keith W. Ingram, Portage, Mich.; Mark J. Schoenlein; Clifford T. Harger, both of Perrysburg, Ohio

[73] Assignee: Owens-Illinois Closure Inc., Toledo, Ohio

[21] Appl. No.: 486,996

[22] Filed: Mar. 1, 1990

[51] Int. Cl.[5] ..... B65B 7/28; B65B 3/20

[52] U.S. Cl. ..... 53/490; 53/314; 53/315; 53/317; 53/331.5

[58] Field of Search ..... 53/315, 317, 490, 314, 53/331.5

[56] References Cited

U.S. PATENT DOCUMENTS

| | | | |
|---|---|---|---|
| 2,435,127 | 1/1948 | Cameron | 53/317 X |
| 2,732,991 | 1/1956 | Bastos et al. | 53/317 X |
| 2,819,516 | 1/1958 | Myers | 53/317 X |
| 2,876,605 | 3/1959 | McElroy et al. | 53/315 |
| 3,071,909 | 1/1963 | Elleman | 53/315 |
| 3,771,284 | 11/1973 | Boeckmann et al. | 53/317 X |
| 3,908,341 | 9/1975 | Conti | 53/315 X |
| 4,199,914 | 4/1980 | Ochs et al. | 53/317 X |
| 4,279,114 | 7/1981 | Bode | 53/315 X |
| 4,308,707 | 1/1982 | Willingham | 53/317 X |
| 4,608,806 | 9/1986 | Haslam et al. | 53/317 X |

*Primary Examiner*—Horace M. Culver

[57] ABSTRACT

A method and apparatus for applying threaded plastic closures to the necks of containers wherein the containers are moved successively in an upright position and threaded plastic caps are successively applied in loose engagement with the neck of the container and wherein successive independent hold-down forces are provided by independently mounted plates in overlying relation to the path of the containers being transferred to the capping machine and substantially simultaneously a friction force is applied to the sides of the threaded closures by a spring preloaded rail while the successive hold-down forces are applied to rotate the closures and partially thread the closure on the neck of the containers.

13 Claims, 5 Drawing Sheets

FIG. 7
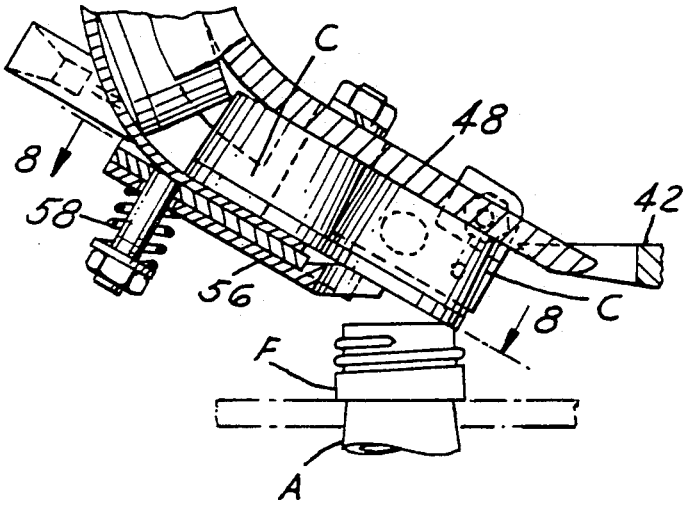
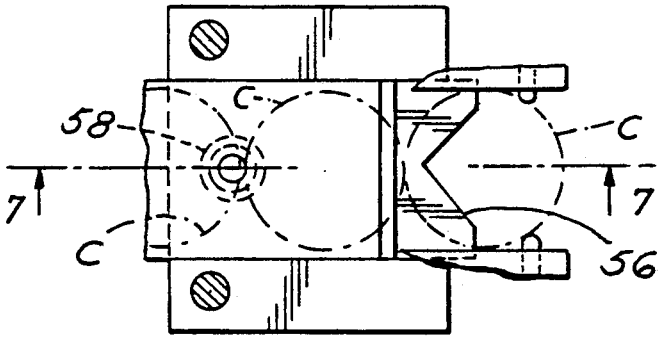
FIG. 8

CLOSURE APPLICATION SYSTEM

This invention relates to applying threaded plastic closures to the threaded necks of containers which have been filled and particularly to the application of threaded closures that include tamper indicating bands that tend to inhibit the application of the closures to the containers.

BACKGROUND OF THE INVENTION

With the advent of threaded plastic closures, it has heretofore been proposed that a closure application system be provided wherein a star wheel with outwardly opening container body pockets and a container guide rail receives filled containers and moves the containers through a closure pickup and pre-tightening apparatus to a closure applicating machine. Such systems are disclosed, for example, in U.S. Pat. Nos. Re. 32,237, 4,624,098 and 4,663,913 which utilize apparatus of the type show in U.S. Pat. Nos. 4,295,320.

Where the plastic cap is of the type having improved tamper indicating bands, such as in U.S. Pat. Nos. 4,550,844, 4,653,657 increased band engagement is provided beneath the annular bead on the neck of the container. The flange is more rigid and has a greatly reduced inner diameter which interferes with the container finish and makes the thread engagement during the pre-application portion of the system more difficult.

SUMMARY OF THE INVENTION

Accordingly among the objectives of the patent invention are to provide a closure application system that increases the efficiency of application of the closure during the closure pickup and pre-tightening portion of the system thereby providing for application of the threaded plastic closure with the tamper indicating bands in a more consistent and effective manner; which system involves a minimal change in the present closure application systems; and which system is relatively less costly.

In accordance with the invention the method and apparatus for applying threaded plastic closures to containers wherein the containers are moved successively in an upright position and threaded plastic caps are successively applied in loose engagement with the neck of the container comprises applying successive independent hold-down forces by independently mounted plates in overlying relation to the path of the containers being transferred to the capping machine and substantially simultaneously applying a friction force to the sides of the threaded closures by a spring preloaded rail while the successive hold-down forces are being applied to rotate the closures and partially thread the closure on the necks of the containers.

DESCRIPTION OF THE DRAWINGS

FIG. 7 is a fragmentary longitudinal sectional view of a portion of the system shown in FIG. 4 and taken along the line 7—7 in FIG. 8.

FIG. 8 is a fragmentary plan view taken along the line 8—8 in FIG. 7.

DESCRIPTION OF THE PREFERRED EMBODIMENT

Figure 1:
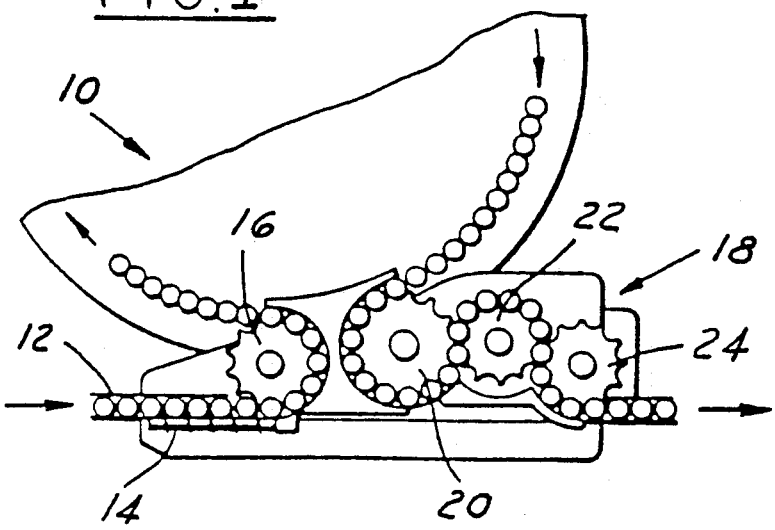
FIG. 1 is a schematic plan view of a closure application systems embodying in the invention.
Figure 2:
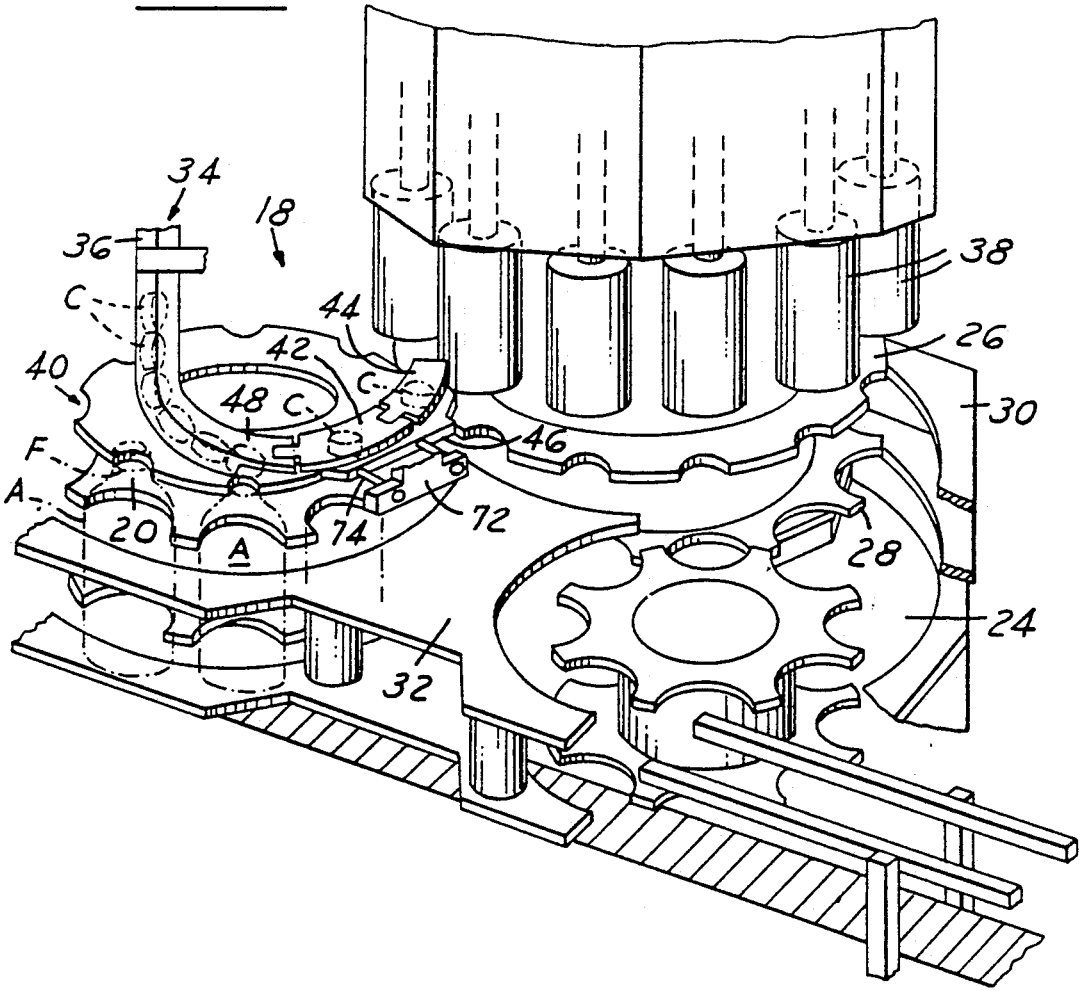
FIG. 2 is a fragmentary perspective view of the systems embodying the invention.
Figure 3:
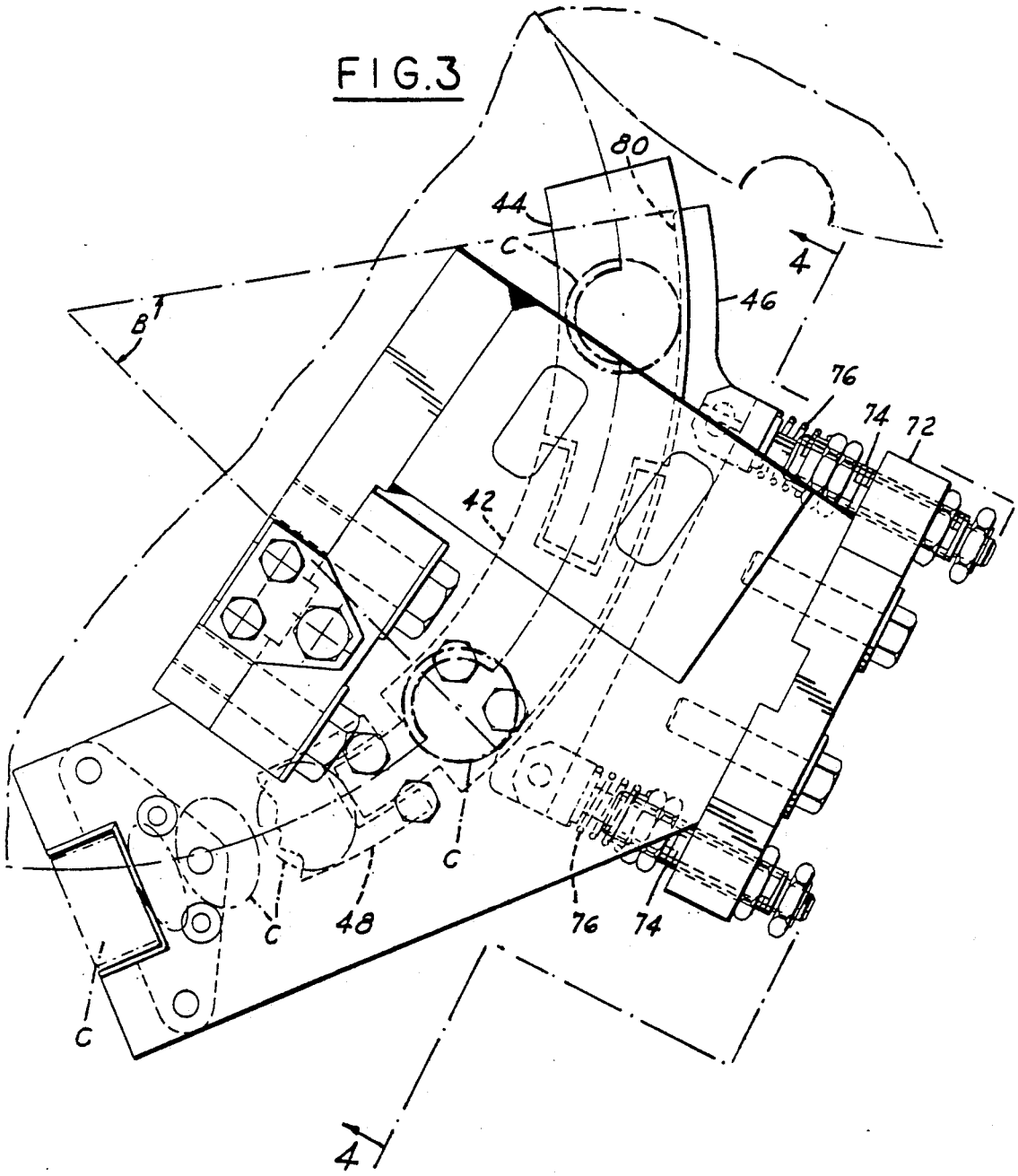
FIG. 3 is a fragmentary plan view of a portion of the system shown in FIG. 2.
Figure 4:
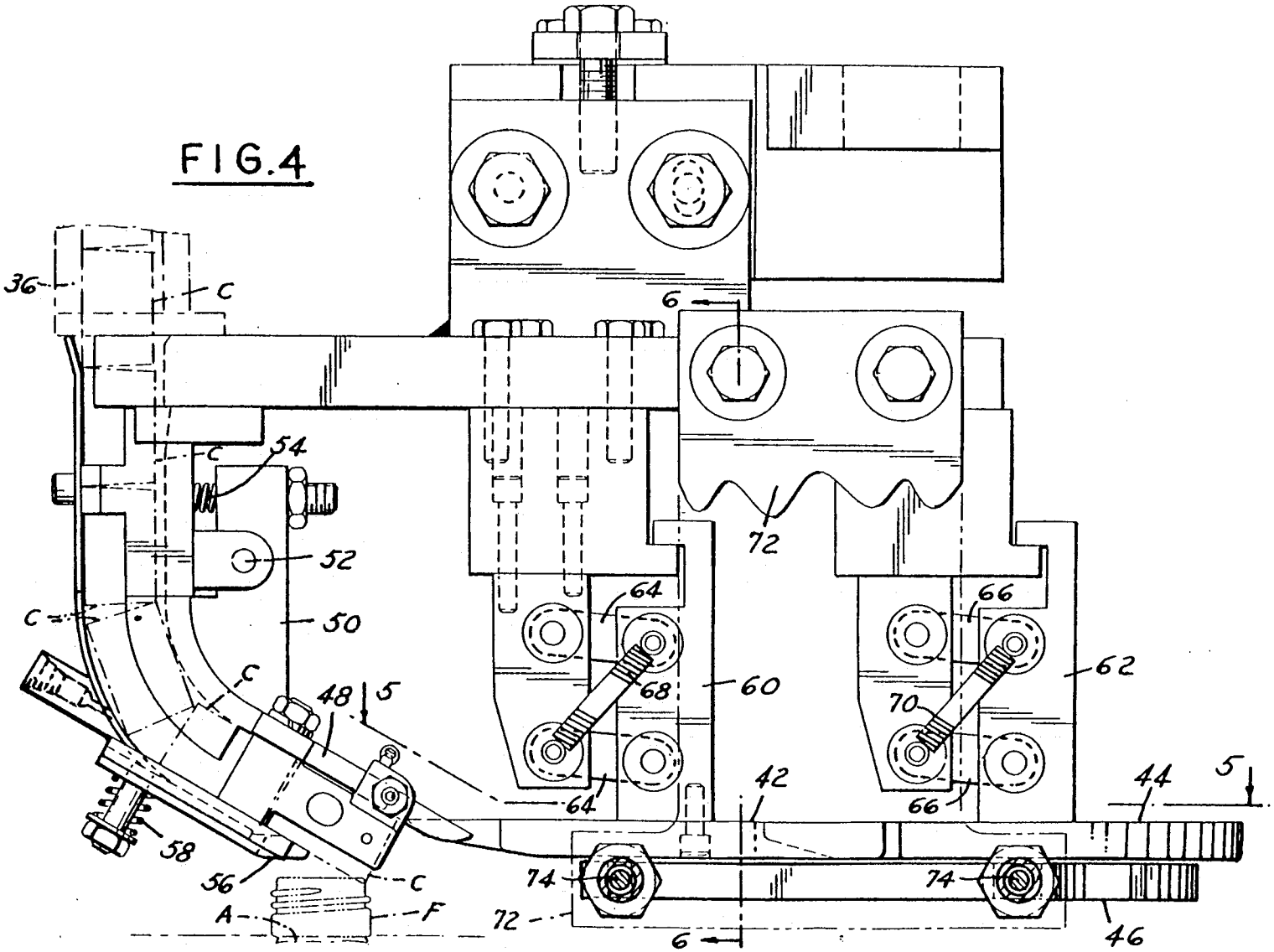
FIG. 4 is a fragmentary sectional view taken along the line 4—4 in FIG. 3.
Figure 5:
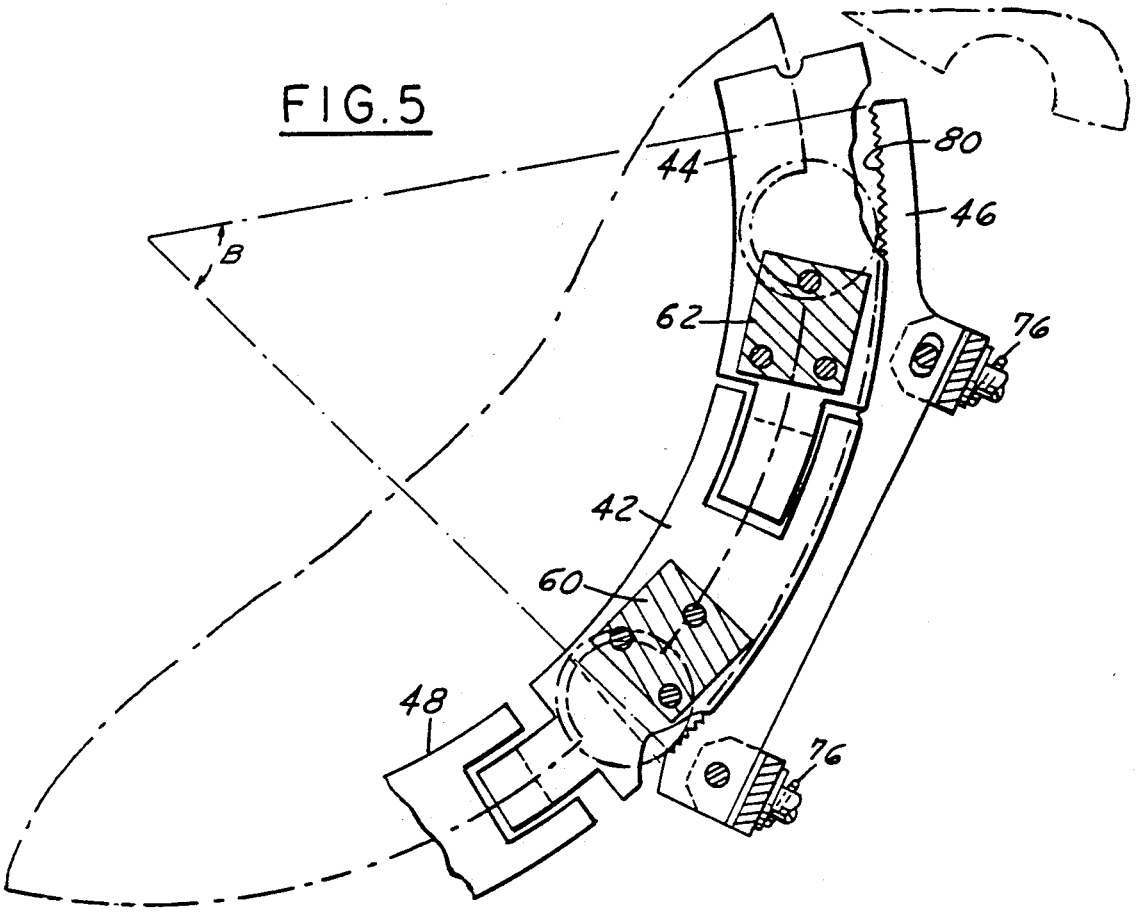
FIG. 5 is a fragmentary sectional view taken along the line 5—5 in FIG. 4.
Figure 6:
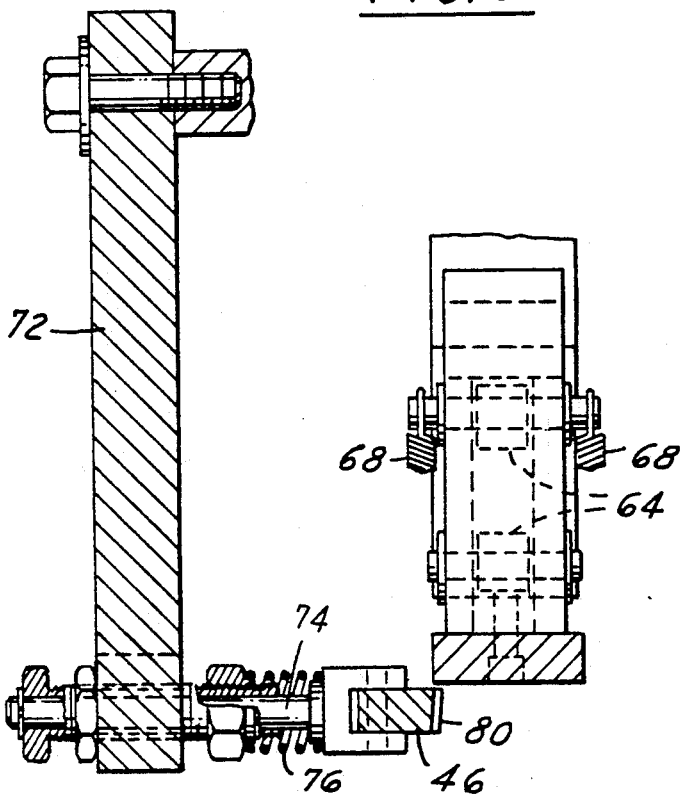
FIG. 6 is a fragmentary sectional view taken along the line 6—6 in FIG. 4.

Referring now to FIGS. 1 and 2 there is illustrated a combination of filling and capping apparatus which may utilized the teachings of this invention. A machine designated generally at 10 receives empty containers from filling in-feed conveyor 12. The containers are transferred from conveyor 12 to the filling machine 10 by an in-feed worm 14 and a filling machine transfer star wheel 16.

Filling machines 10 are well known in the art and include cam or pneumatically operated bottle lifts or pedestals which raise the containers or bottles from the level of the filler transfer star wheel 16 up to and against filler valves. After filling, the containers are lowered away from filler valves by the bottle lifts or pedestals and are transferred to a cap applicating machine designated generally at 18 by a capper in-feed star wheel 20.

Referring now to FIG. 2 there is illustrated a capping machine 18 of the type for the application of closures to the threaded necks of beverage bottles. This machine and conversion apparatus for providing capping heads to effect the application of an internally screw threaded plastic closure to the threaded neck of a bottle are discussed and disclosed in the aforementioned U.S. Patent Nos. Re. 32,237, 4,624,098 and 4,663,913 incorporated herein by reference. Therefore, the mechanism of the entire capping machine will not be described in detail.

Referring to FIG. 2 a rotating turret 22 moves with a rotating capper table 24. Capper star wheels 26 and 28 located above table 24 also rotate with table 22 and provide lateral support to the side wall and neck portions of the containers A as they are moved in a circular path by the rotary table 24. Guide rails 30 and 32 hold the containers in the outwardly opening capper star wheel pockets.

Containers, which may be filled with carbonated beverage or any other liquid product, are supplied to the rotary table 24 by the in-feed or transfer star wheel 20. Before entering the rotary table 22, an internally threaded plastic cap or closure C is loosely deposited on the neck of each container A by a closure feeding mechanism 34, which includes cap feeding chute 36. The closures C are successively engaged by rotating application heads 38 and are applied to the threaded neck of the containers as the containers are moved around beneath the heads 38 by the rotary table 24. The plastic closures C are of the type having a tamper indicating band which resists application to the container, as shown, for example, in U.S. Pat. Nos. 4,550,844 and 4,653,657, incorporated herein by reference.

In accordance with the invention, a pre-tightening mechanism 40 is provided in overlying relationship to the infeed star wheel 20 and functions to apply independently longitudinally spaced vertical forces by independent plates to successive containers A as they are moved through a predetermined arc B by the star wheel 20 so that a force is applied to each closure C for a portion of the arc B that spans a distance sufficient so that each closure C is subjected to successive independent downwardly extending forces. In addition, a spring preloaded friction rail 46 extends along the path of the containers A through this arc to apply a rotating force to the closures C throughout the arc B.

Referring to FIG. 3–8 as the closures C are moved by gravity downwardly through chute 36 they are guided so that they move downwardly and inwardly into the path of a container A so that as the container A is moved by the star wheel 20 a closure C is stripped from the chute 36.

In order to obviate any jamming, the lower portion of the chute 36 is formed with an upper plate 48 that mounted on a bracket 50 pivoted at 52 to the chute 36 and is yieldingly urged downwardly by spring 54 so that it can pivot upwardly about axis 52.

In addition, the lower portion of the chute 36 is provided with a plate 56 that is spring loaded by a spring 58 so that is can pivot downwardly. Thus in the event that engagement between the closure C and the neck of the container A is not in exact registry either of the plates 48, 56 can move to prevent jamming.

As a container A with a closure C thereon is moved further along the arc B, independent forces are successively applied thereto by the successive vertically movable plates 42, 44. The plates 42, 44 are mounted on arms 60, 62 which are connected by pairs of parallel links 64, 66 to a frame and are yieldingly urged downwardly by tension springs 68, 70 extending between the frame and the arm.

As each container moves, the successive plates 42, 44 will apply a force to each closure C assisting in forcing the closure C, with the tamper indicating band, onto the container A and forcing the band of the closure over the flange or bead F on the threaded neck of the container A.

At the same time, the friction rail 46 applies a yielding uniform friction force to the periphery of the closures C (FIGS. 3, 5) to rotate the closures C throughout the arc B. The friction rail 46 is mounted on a bracket 72 through independent pivot shafts 74, each of which is urged radially inwardly by a spring 76. As a result, the friction rail tends to apply the same friction force throughout the arc B.

The length of the friction rail extends along arc B such as to rotate the closure through at least 1.2 revolutions and preferably 1.8 revolutions. The length of the arc B through which the successive plates extend is substantially coextensive with the length of the rail to successively apply independent downward forces on the closures while they are in engagement with the rail rather than a single force throughout the arc B. While transversing the arc B, more than one closure and container will be within the arc B due to the spacing provided by the infeed star wheel 20. Therefore, the dual plates insure that proper downward pressure is applied to both closures and containers.

The extended length of the friction rail results in more than one closure being in contact with the rail during at least part of the pre-threading operation. The friction rail support, as described, is free to float in a generally radial direction to the path of the bottle and closure, and consequently is able to accommodate the variations in the actual path of the closure resulting from bottle deflection and other equipment variations, and do so while maintaining contact with two closures.

It has been found that plastic closures C are successively fed by the above described apparatus, more positive control of the closures is provided by the successive and independent vertical forces for a period of time, namely, through the arc B, sufficient to insure that the improved tamper indicating bands that have a higher interference, as heretofore disclosed and described, are more readily applied. Furthermore, the extended and independently suspended friction rail which is spring loaded radially inwardly maintains frictional engagement for a time sufficient to insure that engagement of the threads has begun before the container and closure pass to the capping machine. In practice it has been found that the arc B should be such that the friction rail maintains contact for about 1.2 revolutions or more and preferably 1.8 revolutions or more of closure rotation.

It has been further found that the friction rail should have longitudinal vertical serrations 80 machined on the inner surface thereof for engagement for ribbing on the exterior side wall of the closure at a positive angle on the order of 0.1–5 degrees so that the serrations 80 extend upwardly and inwardly more uniformly distributing the force on the closures C and containers A. It was found that when the serrations where vertical, there was a tendency for all of the contact to occur on the lower edge on the friction wall.

We claim:

1. In the method of handling of plastic closures for applying threaded caps to threaded necks of containers for delivery to a rotary capping machine wherein the containers are moved in an arcuate path successively in an upright position and a plastic closure is provided in loose engagement on the neck of each container, the improvement for applying plastic closure having tamper indicating bands comprising moving the containers in said arcuate path to said capping machine at a spacing such that more than one closure and container are in a portion of said arcuate path, providing successive independent closely spaced vertical forces downwardly into said portion of said arcuate path of the closures and containers such that the containers with the closures thereon are subjected successively to independent downward forces on the loosely positioned closures as the containers and closures are moved in said portion of said arcuate path, and simultaneously applying a friction force to the periphery of the closures throughout a portion of the arcuate path during which the downward forces are being applied such that more than one closure has said force applied thereto and each closure is rotated relative to the container through at least one rotation to insure a pre-threading of the closure on the container before it is delivered to the capping machine.

2. The method set forth in claim 1 wherein said independent vertical forces are provided by successively closely positioned independent substantially horizontal plates yieldingly urged downward into the arcuate path of the closures and containers.

3. The method set forth in claim 2 wherein said friction force is provided by a continuous friction rail that extends along said portion of said arcuate path and is yieldingly urged radially inwardly by spring forces throughout its length.

4. The method set forth in claim 3 wherein said closures have vertical ribs thereon and said frictional rail is provided with complementary serrations that are inclined upwardly and inwardly with respect to the axis of the containers.

5. The method set forth in any one of claims 1–4 wherein said independent vertical forces and friction forces are applied for a distance such that each closure is rotated through at least 1.2 revolutions.

6. The method set forth in any one of claims 1–4 wherein said independent vertical forces and friction forces are applied for a distance such that each closure is rotated through at least 1.8 revolutions.

7. In an apparatus for handling of plastic closures for applying threaded caps to threaded necks of containers for delivery to a rotary capping machine wherein the containers are moved in an arcuate path successively in an upright position and a plastic closure is provided in loose engagement on the neck of each container, the improvement for applying plastic closures having tamper indicating bands comprising means for moving the containers in said arcuate path to said capping machine at a spacing such that more than one closure and container are in a portion of said arcuate path, means for providing successive vertical forces downwardly into the portion of the arcuate path of the closures and containers such that the containers with the closures thereon are subjected successively to independent downward forces on the loosely positioned closures as the containers and closures are moved in said portion of said arcuate path, and means for simultaneously applying a friction force to the periphery of the closures throughout the portion of the arcuate path during which the downward forces are being applied such that more than one closure has said force applied thereto and that the closure is rotated relative to the container through at least one rotation to insure a pre-threading of the closure on the container before it is delivered to the capping machine.

8. The apparatus set forth in claim 7 wherein said means for applying the vertical forces comprise successive closely spaced hold-down plates on the apparatus including an arm on each plate, parallel links supporting said arms for vertical movement, and a spring associated with each plate for yieldingly urging the plate downwardly into the path of the loosely applied closure and container.

9. The apparatus set forth in claim 8 wherein said means for applying said friction force comprises a friction rail having a length such that it extends along said portion of said arcuate path and means for supporting said friction rail comprises spring means applying a yielding force throughout the length of the friction rail.

10. The apparatus set forth in claim 9 wherein said friction rail includes longitudinally spaced serrations extending upwardly and inwardly at an acute angle.

11. The apparatus set forth in claim 10 wherein said acute angle ranges between 0.1°–5°.

12. The apparatus set forth in any one of claims 7–11 wherein the length of said friction force means and said vertical force means is such that each closure is rotated through at least 1.2 revolutions.

13. The apparatus set forth on any one of claims 7–11 wherein the length of said friction force means and said vertical force means is such that each closure is rotated through at least 1.8 revolutions.

* * * * *